US005434375A

United States Patent [19]

Kawada et al.

[11] Patent Number: 5,434,375

[45] Date of Patent: Jul. 18, 1995

[54] SWITCH WITH CONNECTOR

[75] Inventors: Yasuyoshi Kawada, Niwa; Yoshiyasu Kawai, Okazaki; Toshihiro Uchida, Toyota, all of Japan

[73] Assignee: Kabushiki Kaisha Tokai-Rika-Denki-Seisakusho, Aichi, Japan

[21] Appl. No.: 154,525

[22] Filed: Nov. 19, 1993

[30] Foreign Application Priority Data

Nov. 25, 1992 [JP] Japan ..... 4-314940

[51] Int. Cl.[6] ..... H01R 13/70

[52] U.S. Cl. ..... 200/51 R; 200/51.07; 439/27

[58] Field of Search ..... 200/51 R, 51.07, 51.08, 200/51.12, 51.13, 51.14, 51.16; 439/13, 18, 27

[56] References Cited

U.S. PATENT DOCUMENTS 2,534,875 12/1950 Miller ..... 200/51.56
4,010,336 3/1977 Trevithick ..... 200/51 R

FOREIGN PATENT DOCUMENTS 0104358 4/1984 European Pat. Off. .
1445976 8/1976 United Kingdom .

*Primary Examiner*—Robert M. Fetsuga
*Assistant Examiner*—David J. Walczak
*Attorney, Agent, or Firm*—Oliff & Berridge

[57] ABSTRACT

A switch with a connector, having a switch body and a first connector member. The switch body is screwed into and fixed to a supporting member. The first connector member is mounted to the switch body and provided such that a direction of connecting a second connector member to the first connector member is disposed at a predetermined angle with respect to a direction of inserting the switch body. The first connector member is disposed so as to be rotatable around an axis along the direction of inserting the switch body. When the first connector member is rotated around the axis along the direction of inserting the switch body after the switch body is fixed to the supporting member, the first connector member can be set at a predetermined position for connecting the first connector member to the second connector member.

20 Claims, 2 Drawing Sheets

SWITCH WITH CONNECTOR

BACKGROUND OF THE INVENTION

1. Field of the Invention

The present invention relates to a switch with a connector, which is applied to a switch for a back up lamp disposed in, for example, a motorcar.

2. Description of the Related Art

In this type of a switch with a connector portion, for example a switch for a back up lamp, the connector portion is integrally constructed with the switch body. The switch body is screwed into and fixed to a vehicle body as a supporting member. In this case, the direction of connecting the connector portion is provided so as to be disposed along an axial center of the switch body.

In relation to this, in recent years, because of mounting space problems, there was a demand for a so-called "horizontal switch", in which the direction of connecting a connector portion is provided so as to be disposed at a certain ankle (e.g., at right angles) with respect to an axial center of a switch body. Accordingly, a switch, in which the direction of connecting the connector portion is bent at right angles with respect to an axial center off a switch body was easily contemplated.

However, in the aforementioned structure in which tile direction of connecting the connector portion was disposed at a certain angle, there were drawbacks such that, when the switch body was screwed into and fixed to a vehicle body, it was not possible to know where the connecting area position of the connector portion was before the switch body was screwed into and fixed to the vehicle body. Accordingly, the direction of connecting the connector portion could not be found. Accordingly, in this structure the length of a wiring harness which is used for connecting the connector portion of the switch to another connector portion pulled out from a vehicle body must be lengthened so that a slack portion is formed. Further, a structure having a space for accommodating the slack portion of the wiring harness must be formed and fixing the slack portion to the vehicle body is needed.

SUMMARY OF THE INVENTION

Therefore, in view of the aforementioned facts, it is an object of the present invention to provide a switch with a connector, in which a direction of connecting a connector portion is disposed at a certain angle with respect to an axial center of a switch body and there is no need that a wiring harness be excessively made longer.

In accordance with the present invention, there is provided a switch with a connector, which comprises a switch body screwed into and fixed to a supporting member, and a first connector member mounted to the switch body and provided such that a direction of connecting a second connector member to the first connector member is disposed at a predetermined angle with respect to a direction of screwing-in of the switch body, the first connector member being disposed so as to be rotatable around an axis along the direction of screwing-in of the switch body.

In the aforementioned structure, since the first connector member is disposed so as to be rotatable around an axis along the direction of screwing-in of the switch body with respect to the switch body, the first connector member is rotated after the switch body is screwed into and fixed to a vehicle body, thereby making it possible to set a connecting portion of the first connector member at a predetermined position. As a result, there is no need for a wiring harness of the second connector member, which connects with the connector portion of the switch (namely, the first connector member), to be made excessively long.

As described above, the present invention is constructed such that the direction of connecting the second connector member with the first connector member is disposed at a certain angle with respect to an axial center off the switch body, and the first connector member is provided so as to be rotatable around an axis along the direction of screwing-in of the switch body. Accordingly, the present invention results in the excellent effects of being capable of setting the position of connecting the second connector member, namely, the position of connecting the connecting portion, at a predetermined position after the switch body is screwed into and fixed to the vehicle body, and eliminating the need for the wiring harness of the second connector member, which connects with the first connector member, to be made excessively long.

DESCRIPTION OF THE PREFERRED EMBODIMENTS

Figure 1:
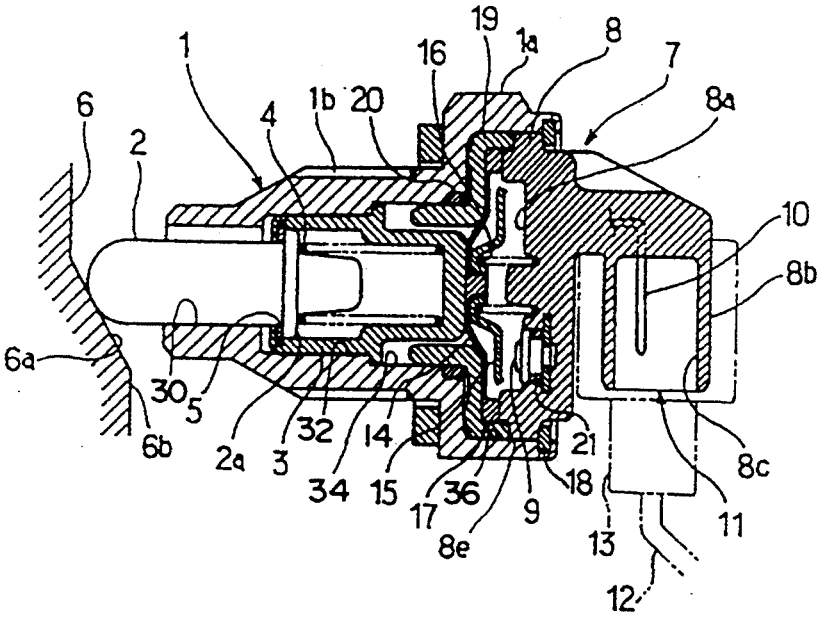
FIG. 1 is a longitudinal sectional view illustrating a switch according to a first embodiment of the present invention.
Figure 4:
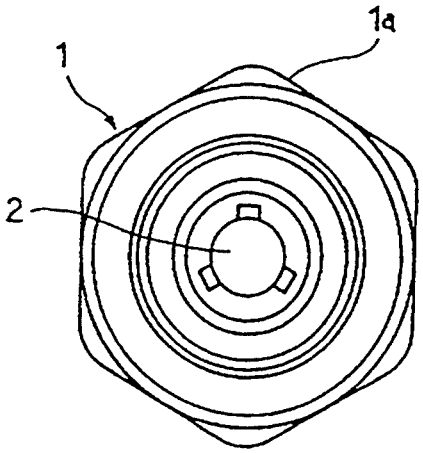
FIG. 4 is a left side view illustrating the switch according to the first embodiment of the present invention.

Referring now to the accompanying drawings, a first embodiment of the present invention which is applied to a switch for a back up lamp of a motorcar will be described below. Note that "right" and "left" shown in the specification, respectively represent the right and left directions as shown in FIG. 1. FIG. 1 illustrates the overall structure of the switch for a back up lamp. A switch body 1 has a substantially cylindrical shape with an inner peripheral portion thereof being provided such that the inner diameter dimensions of the inner peripheral portion become sequentially larger in four stages from the left-to-right direction in FIG. 1 so as to form a first inner peripheral portion 30, a second inner peripheral portion 32, a third inner peripheral portion 34, and a fourth inner peripheral portion 36. At the portion of the switch body 1 having the largest outer diameter, a nut portion 1*a* used for tightening is formed (see FIGS. 2 and 4). Further, a threaded portion 1*b* for screwing is formed at the outer peripheral portion of the switch body 1 at the left side of the nut portion 1*a* (see FIG. 1).

Within the first inner peripheral portion 30 at the leftmost side of the switch body 1, a shaft 2 is supported so as to be movable in a direction along an axial center of the switch body 1. Further, within the second inner peripheral portion 32 of the switch body 1, an inner shaft 3 is supported so as to be movable in the direction along the axial center of the switch body 1. The inner shaft 3 has a substantially cylindrical shape, with a right end thereof being closed. A right end portion of the shaft 2 is inserted into the inner shaft 3 from a left-hand opening portion of the inner shaft 3. A coil spring 4 is disposed in a space which is enclosed by the inner shaft 3 and the shaft 2 (i.e., the coil spring 4 contacts the right-hand inner surface of the inner shaft 3). The coil spring 4 urges the shaft 2 toward the left with respect to the inner shaft 3.

A flange portion 2*a* which is formed in the vicinity of the right end portion of the shaft 2 is provided so as to engage a stopper member 5 formed at an inner peripheral portion of the inner shaft 3 at the left end thereof. Accordingly, the shaft 2 is prevented from being pulled out of the inner shaft 3. A left end portion of the shaft 2 projects out from a left end portion of the switch body 1 and is provided so as to be brought into contact with an actuator 6 disposed on the side of the vehicle.

The actuator 6 is provided to be movable in a vertical direction in FIG. 1. When a transmission (not shown) selectively placed in a reverse gear, the actuator 6, together with the operation of the transmission, moves upward From its position indicated in FIG. 1. Then, the actuator 6 moves upward, the left end portion of the shaft 2 abuts the actuator 6 and simultaneously moves along a slant portion 6*a* of the actuator 6, so as to be brought into contact with a contact surface portion 6*b* of the actuator 6. This results in the shaft 2 being moved toward the right in FIG. 1.

Meanwhile, a rotor 7 is inserted into and engaged with the fourth inner peripheral portion 86 disposed at the rightmost side of the switch body 1 and the third inner peripheral portion 84 disposed to the left thereof. The rotor 7 is supported within the switch body 1 so as to be rotatable about an axial center of the switch body 1. The rotor 7 will be described below in detail. A base body 8 of the rotor 7 is made from of an insulating material (e.g., a polyamide resin with glass) and includes a concave portion 8*a* formed at a left end face portion of the base body 8. A connector-housing portion 8*b* is formed at a right end portion of the base body 8.

Two fixed contacts 9 (only one is seen in FIG. 1) are respectively disposed via an O-ring 21 at the bottom of the concave portion 8*a* of the base body 8. Further, as illustrated in FIG. 1 through FIG. 8, the connector-housing portion 8*b* comprises a cavity portion 8*c* and has an external configuration of a rounded rectangular cylinder, when facing the bottom of the connector-housing portion 8*b* from an opening end thereof. Two terminals 10 are disposed within the cavity portion 8*c* so as to be arranged in parallel with each other, with each one end portion of the terminals 10 being extended toward the opening end of the connector-housing portion 8*b*. The terminals 10, the connector-housing portion 8*b* and the cavity portion 8*c* form a connector portion 11.

An intermediate portion of each terminal 10 is embedded in the base body 8 and another end portion thereof is connected to each fixed contact 9. It should be noted that the O-ring 21 disposed between the fixed contacts 9 and the base body 8 is used to prevent penetration of water, oil, and the like into the concave portion 8*a* of the base body 8 from the connector portion 11.

In this case, the direction perpendicular to a circumferential direction of an inside periphery of the connector-housing portion 8*b*, and the axial direction of the terminals 10 are respectively set to be substantially perpendicular to an axial center of the switch body 1. The direction of connecting the connector portion 11 with a connector portion 18 of a wiring harness 12 is set to be substantially perpendicular to the axial center of the switch body 1.

Figure 2:
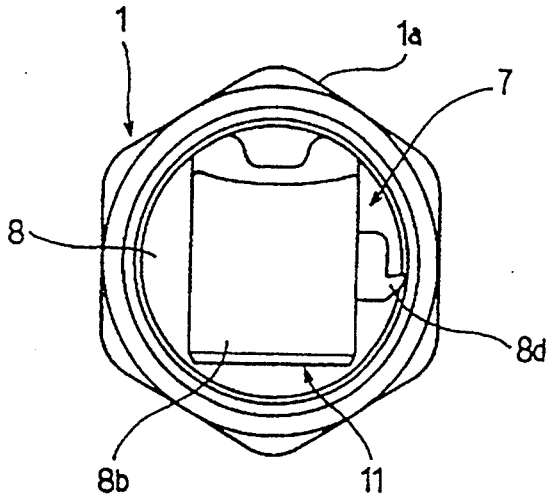
FIG. 2 is a right side view illustrating the switch according to the first embodiment of the present invention.
Figure 3:
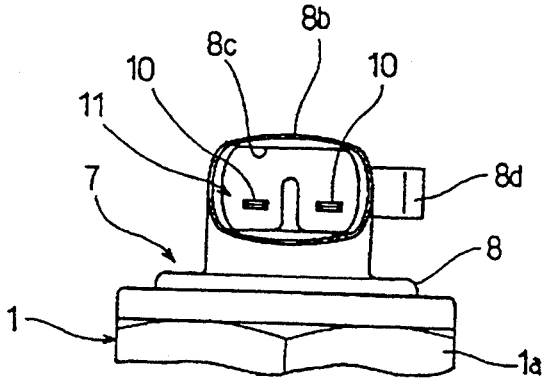
FIG. 3 is a bottom plan view illustrating the switch according to the first embodiment of the present invention.

FIG. 1 illustrates that an opening portion off the connector-housing portion 8*b*, namely, a connecting has an opening portion oriented downward. As indicated by two-dot chain lines in FIG. 1, the connector portion 13 of the wiring harness 12 pulled out from the vehicle is engaged with and connected to the connector portion 11. Meanwhile, as illustrated in FIGS. 2 and 3, a lock pawl 8*d* is formed so as to protrude from a portion of an outer peripheral portion of the connector-housing portion 8*b*. The lock pawl 8*d* engages an engaging hole (not shown) formed in the connector portion 13 of the wiring harness 12, so that the connector portion 11 and the connector portion 13 are both locked.

On the other hand, on the left side of the concave portion 8*a* of the base body 8 (see FIG. 1), a substantially disc-shaped diaphragm 14 is disposed which closes and seals the concave portion 8*a*. A substantially disc-shaped moving contact 15 is disposed on an inside surface of the diaphragm 14, i.e., on the side opposite the concave portion 8*a*. In this case, a convex portion is formed at an intermediate portion of the diaphragm 14 on the inside surface thereof which engages with a hole formed in the center of the moving contact 15. Further, a coil spring 18 is disposed between a right side face (in FIG. 1) of the moving contact 15 and the bottom surface of the concave portion 8*a* of the base body 8. In a normal state, an urging force of the coil spring 16 causes the moving contact 15 and the diaphragm 14 to be urged toward the left side in FIG. 1. It should be noted that the spring force of the coil spring 16 is set to be weaker than that of the coil spring 4.

Further, a center portion of the diaphragm 14 on the outside surface thereof, i.e., on the left side surface thereof in FIG. 1, is brought into contact with a right end portion of the inner shaft 3. As the inner shaft 3 moves toward the right side in FIG. 1, the diaphragm 14 is pushed toward the right, and simultaneously, the moving contact 15 moves toward the right so as to contact the two fixed contacts 9 and be conductive therewith. The fixed contacts 9, the moving contact 15, the diaphragm 14, the coil spring 16, and the like, form a switch portion 17.

Meanwhile, a flange portion 8*e* is formed at and protrudes from an outer peripheral portion of the base body 8. When the flange portion 8*e* abuts a fastening washer 18 which is mounted to a proximal right end portion of the fourth inner peripheral portion 36 of the switch body 1, the base body 8 is provided so as to not be pulled from the switch body 1. Accordingly, the rotor 7 is not pulled out From the switch body 1 and is provided so as to be rotatable therein.

An O-ring support member 19 made from, e.g., a polyamide resin with glass, engages with and is fixed to an outer peripheral portion of the base body 8 and has a right end portion abutting the flange portion 8*e*. Further, the O-ring support member 19 is constructed such that a right side surface thereof is brought into contact with an outside surface and an outer periphery of the diaphragm 14, and a left side surface thereof is brought into contact with a portion of the switch body 1 from the third inner peripheral portion 34 to the fourth inner peripheral portion 36. Since the O-ring support member 19 is fixed to the base body 8, the O-ring support member 19 and the base body 8 rotate integratedly.

An O-ring 20, which is made from, e.g., NBR (nitrile butadiene rubber), is disposed between an inner peripheral portion of the switch body 1 and an outer periphery of the O-ring support member 19. The O-ring 20 and the diaphragm 14 both are used for preventing the penetration of water from the outside and vehicle oil into a region of the contacts 9 and 15. Further, friction between the O-ring 20 and the O-ring support member 19 allows the rotational position of the O-ring support member 19, namely, the base body 8, to be maintained.

In this state, when the base body 8 is rotated, the O-ring support member 19 engaged with the base body 8 rotates integrally therewith. In accordance with this rotation, the diaphragm 14, the moving contact 15 and the coil spring are provided to rotate together. Namely, a rotating portion includes the base body 8, the fixed contacts 9, the O-ring support member 19, the diaphragm 14, the moving contact and the coil spring 16.

Meanwhile, in the foregoing, there is a possibility that, when the base body 8 is rotated, the rotational amount of the moving contact 15 may be smaller than that of the base body 8, i.e., the respective rotational amounts of the moving contact 15 and the base body 8 may not be the same. However, there does not occur any difficulty when the moving contact 15 and the fixed contacts 9 contact each other or are separated from each other because the moving contact 15 has a disc-shaped configuration.

When the switch having the aforementioned structure is mounted to a vehicle body, the switch body 1 is inserted and screwed into a mounting hole (not shown) of the vehicle body, so as to be tightly fixed to the vehicle body. After securing the switch body 1, the rotor 7, namely, the connecting portion 11 is rotated about an axial center off the switch body 1, and is located at a position where the connector portion 11 of the wiring harness 12 is easily connected to the connector portion 11. Thereafter, the connector portion 13 of the wiring harness 12 is engaged with and connected to the connector portion 11.

Next, an on-off control operation of the switch having the aforementioned structure will be described below. FIG. 1 illustrates the switch in a turned-off state, in which the moving contact 15 is separated from the fixed contacts 9. In this state, when a transmission is selectively placed in a reverse gear, the actuator 6, together with the operation of the transmission, moves upward. Accordingly, the left end portion of the shaft 2 abuts the actuator 6 and simultaneously moves along the slant portion **6*a* of the actuator 6, so as to be brought into contact with the contact surface portion 6*b*. This results in the shaft 2** moving toward the right.

In this case, since an urging force of the coil spring 4 disposed between the shaft 2 and the inner shaft 3 is set to be larger than that of the coil spring 18 disposed between the moving contact 15 and the base body 8, the shaft 2 and the inner shaft 3 integrally move toward the right side. The movement of the inner shaft 3 causes the diaphragm 14 and the moving contact 15 to be moved toward the right. As a result, the moving contact 15 contacts the fixed contacts 9 so that the switch is turned-on.

Meanwhile, even after the moving contact 15 abuts the fixed contacts 9, when the shaft 2 is moved toward the right (i.e., when the shaft 2 is in an over-stroke state), only the coil spring 4 deforms compressively, with the shaft 3 being in a stopped state.

According to the present embodiment having the aforementioned structure, the rotor 7, namely, the connector portion 11 is provided so as to be rotatable about the axial center of the switch body 1 with respect to the switch body 1. Accordingly, when the connector portion 11 is rotated after the switch body 1 is screwed into and fixed to vehicle body, the direction of connecting the connector portions 11, 13 together, i.e., the position of the connector portion 11, can be set at a predetermined position (i.e., a desired position). As a result, it is unnecessary that the wiring harness 12 disposed at the side of the vehicle and in connection with the connector portion 11 of the switch be made excessively long. Therefore, unlike a conventional structure, it is no longer necessary to provide a space for accommodating the slack portion of the wiring harness 12 or fix the slack portion thereof to the vehicle.

Meanwhile, in the foregoing, although the direction of connecting the connector portion 11 is provided so as to be perpendicular to the axial center of the switch body 1, the present invention is not limited to the same. The present invention can be also constructed such that the angle of the direction of connecting the connector portion 11 with respect to the axial center of the switch body 1 may be set to a desired value when needed.

What is claimed is:

1. A switch with a connector, comprising:

a switch body adapted to be screwed into and fixed to a supporting member; and a first connector member rotatably mounted to said switch body and provided such that a direction of connecting a second connector member to the first connector member is disposed at a predetermined angle with respect to an axial direction of screwing-in of said switch body, said first connector member being disposed so as to be rotatable relative to the switch body around an axis along the axial direction of said switch body.

2. A switch with a connector according to claim 1, wherein said switch body has a connecting means, said connecting means connecting said first connector member to said switch body.

3. A switch with a connector according to claim 2, wherein said connecting means has a holding member, said holding member holding at least a portion of said first connector member.

4. A switch with a connector according to claim 1, wherein said switch body has rotational position-maintaining means, said rotational position-maintaining means maintaining said first connector member at a predetermined rotational position of said switch body.

5. A switch with a connector according to claim 4, wherein said rotational position-maintaining means maintains said first connector member at a predetermined rotational position due to frictional force.

6. A switch with a connector according to claim 1, wherein said first connector member includes a plurality first contact members, said first contact members being electrically connected to a plurality of terminals which are disposed in said first connector member and which are provided such that a number of said terminals corresponds to a number of said first contact members.

7. A switch with a connector according to claim 1, wherein said first connector member has a first contact member and wherein said switch body has a second contact member, said second contact member being provided so as to contact said first contact member even when said first contact member rotates with the rotation of said first connector member.

8. A switch with a connector according to claim 7, further comprising:

foreign matter entry prevention means which prevents foreign matter from entering into a region of contact of said first contact member and said second contact member.

9. A switch with a connector according to claim 7, further comprising:

moving means for moving said second contact member by an external force in a direction in which said second contact member connects with and separates from said first contact member.

10. A switch with a connector according to claim 1, wherein said first connector member has separation-preventing means for preventing separation of said second connector member which connects with said first connector member.

11. A switch with a connector, comprising:

a switch body adapted to be screwed into and fixed to a supporting member: and a first connector member rotatably mounted to said switch body and provided such that a direction of connecting a second connector member to the first connector member is disposed at a predetermined angle with respect to an axial direction of screwing-in of said switch body, said first connector member being disposed so as to be rotatable relative to said switch body around an axis along the axial direction of screwing-in of said switch body; and connecting means, disposed in said switch body, for connecting said first connector member to said switch body.

12. A switch with a connector according to claim 11, wherein said connecting means has a holding member, said holding member holding at least a portion of said first connector member.

13. A switch with a connector according to claim 11, wherein said switch body has rotational position-maintaining means, said rotational position-maintaining means maintaining said first connector member at a predetermined rotational position of said switch body clue to frictional force.

14. A switch with a connector according to claim 11, wherein said first connector member includes a plurality of first contact members, said first contact members being electrically connected to a plurality of terminals which are disposed in said first connector member and which are provided such that a number of said terminals corresponds to a number off said first contact members.

15. A switch with a connector according to claim 11, wherein said first connector member has a first contact member and said switch body has a second contact member, said second contact member being provided so as to contact said first contact member even when said first contact member rotates with the rotation of said first connector member.

16. A switch with a connector according to claim 15, further comprising:

foreign matter entry prevention means which prevents foreign matter from entering into a region of contact of said first contact member and said second contact member.

17. A switch with a connector according to claim 15, further comprising:

moving means for moving said second contact member by an external force in a direction in which said second contact member connects with and separates from said first contact member.

18. A switch with a connector according to claim 17, wherein said moving means has a moving member, said moving member being supported so as to be movable within said switch body and provided so as to connect with said second contact member.

19. A switch with a connector according to claim 18, wherein said moving means has an external force-receiving member, said external force-receiving member being formed so as to protrude from an outer peripheral surface of said switch body and interconnect with said moving member, said external force-receiving member receiving said external force and transmitting said external force to said second contact member via said moving member.

20. A switch with a connector according to claim 11, wherein said first connector member has separation-preventing means for preventing separation of said second connector member which connects with said first connector member.

* * * * *